US005441191A

United States Patent [19]

Linden

[11] Patent Number: 5,441,191

[45] Date of Patent: Aug. 15, 1995

[54] INDICATING "STAPLES LOW" IN A PAPER STAPLER

[76] Inventor: Gerald E. Linden, 2008 Cotswold Dr., Orlando, Fla. 32825

[21] Appl. No.: 175,975

[22] Filed: Dec. 30, 1993

[51] Int. Cl.[6] ..... B25C 5/16

[52] U.S. Cl. ..... 227/120; 227/156

[58] Field of Search ..... 227/120, 156, 119, 127

[56] References Cited

U.S. PATENT DOCUMENTS

| | | | |
|---|---|---|---|
| 3,630,428 | 12/1971 | Olney | 227/128 |
| 4,591,086 | 5/1986 | Campbell et al. | 227/120 |
| 4,715,522 | 12/1987 | Jordan | 227/120 |
| 4,717,060 | 1/1988 | Cotta | 227/120 |
| 4,726,505 | 2/1988 | Okazaki | 227/120 |
| 4,795,073 | 1/1989 | Yamamoto et al. | 227/120 |

*Primary Examiner*—Scott A. Smith

[57] ABSTRACT

A paper stapler is provided with a pin that protrudes from the front end of the magazine when the stapler is low on staples. The pin is distinctively colored (e.g., red), to visually alert the user to the fact that the magazine will soon need to be loaded with a fresh supply of staples. Alternatively, when the stapler is low on staples, the top surface of the top housing of the stapler is deformed, when a button-like element that is otherwise flush with the top surface begins to extend above the top surface. This provides the user with a tactile cue that the stapler is low on staples. Both tactile and visual cues can be provided to the user indicative of the fact that there is a relatively low number of staples remaining in the magazine.

19 Claims, 4 Drawing Sheets

INDICATING "STAPLES LOW" IN A PAPER STAPLER

TECHNICAL FIELD OF THE INVENTION

The present invention relates to the construction and use of staplers, such as those commonly found in a home or office for stapling multiple sheets of paper together.

BACKGROUND OF THE INVENTION

FIG. 1 illustrates the major operative components of a common home or office paper stapler 100 (such as a "711" or "747" Swingline-TM stapler, or staplers from other manufacturers), which include:

- a magazine (or lower housing) 102 having two side parts 102*a* and 102*b* and a front part 102*c;*
- a rail (or staple holder) 104, within the lower housing 102, supporting a plurality of staples 106;
- a follower (staple mover) 108, within the housing for urging the staples 106 forward, towards the front of the housing;
- a cap (upper housing) 112 hinged (at the rear, not shown) to the lower housing 102; and
- a staple-driver (blade) 110 in the cap 112 that pushes the frontmost staple downward (as viewed) out of a discharge opening (not shown) in the bottom of the front end 102*c* of the lower housing (so that the staple pierces papers and is formed by an anvil, not shown) when the cap 112 is pushed downward (as viewed).

U.S. Pat. No. 3,630,428, incorporated by reference herein, is an example of a typical prior art stapler, to which the present invention is applicable.

A typical home/office stapler will hold up to 50–100 staples in the magazine. However, in use, it is extremely frustrating to the user when there are no staples left, when the user is trying to staple sheets together. In some cases, the stapler will not perform well when there are only a few (e.g., 5–10) staples left in the magazine. This requires finding more staples to load into the magazine, and loading them, just when all the user wants to do is staple.

To the end of indicating that there are relatively few staples left in the magazine, it is known to provide a view hole 120 in one or both sides of the magazine. In this manner, the user can supposedly observe that there are at least a certain number of staples (106) in the magazine, by viewing them through the opening (120), and can supposedly ascertain when the follower 108 has advanced as far as the opening. In FIG. 1, the front of the follower 108 is shown supposedly viewable through an elongated opening 120, in a color contrasting with the color of last of the staples 106. In practice, this whole concept is very hypothetical, since the view hole (e.g., 120) is not viewable at all from the front of the stapler, and from the side requires a keen observer to notice that the staples are running out. In other words, providing a view hole is relatively unergonomic and easily unnoticeable, and is totally useless for people with impaired vision. Further, there is no tactile cue provided indicating to the user that the stapler is low on staples.

SUMMARY OF THE INVENTION

It is therefore an object of the present invention to provide an improved stapler.

It is a further object of the present invention to provide means for indicating to a user, in a very ergonomic and unambiguous manner, that there are only a few staples left in a stapler magazine.

It is a further object to provide means for a user to ascertain when a stapler is in need of being loaded with a fresh supply of staples.

It is a further object of the invention to provide a noticeable visual cue to the user indicating that the stapler is low on staples.

It is a further object of the invention to provide a user-friendly tactile cue to the user indicating that the stapler is low on staples.

According to the invention, the staple follower (pusher) of a common paper stapler is provided with means for indicating to the user of the stapler that the stapler is low on (including out of) staples.

In one embodiment, a pin is provided on the staple follower, and, when the staple follower advances to a certain point (indicative of a predetermined low amount of staples remaining in the stapler), the pin begins protruding through a hole in the front of the lower housing (magazine) of the stapler. Preferably, the pin is straight, is secured at one end to the top surface of the staple follower, and the other end of the pin extends longitudinally from the front of the staple follower. The pin may be centered on the staple follower, or can be disposed off center. The pin may also be formed with a vertical jog, if necessary, to extend above the top surface of the staple follower. In either case, the pin extends above staples in front of the staple follower. Preferably, the front end of the pin, which will protrude from the front of the magazine when the stapler is low on staples, is brightly colored (e.g., red) to augment the user's visual cue that the stapler is low on staples.

In another embodiment, a cam element is provided, preferably integrally, on the top surface of the staple follower, and the top housing (cap) is provided with a button-like element that is lifted (upward) by the cam element when the staple follower advances to a certain point indicative of a predetermined low amount of staples remaining in the stapler.

Other objects, features and advantages of the invention will become apparent in light of the following description thereof.

DETAILED DESCRIPTION OF THE INVENTION

Figure 1:
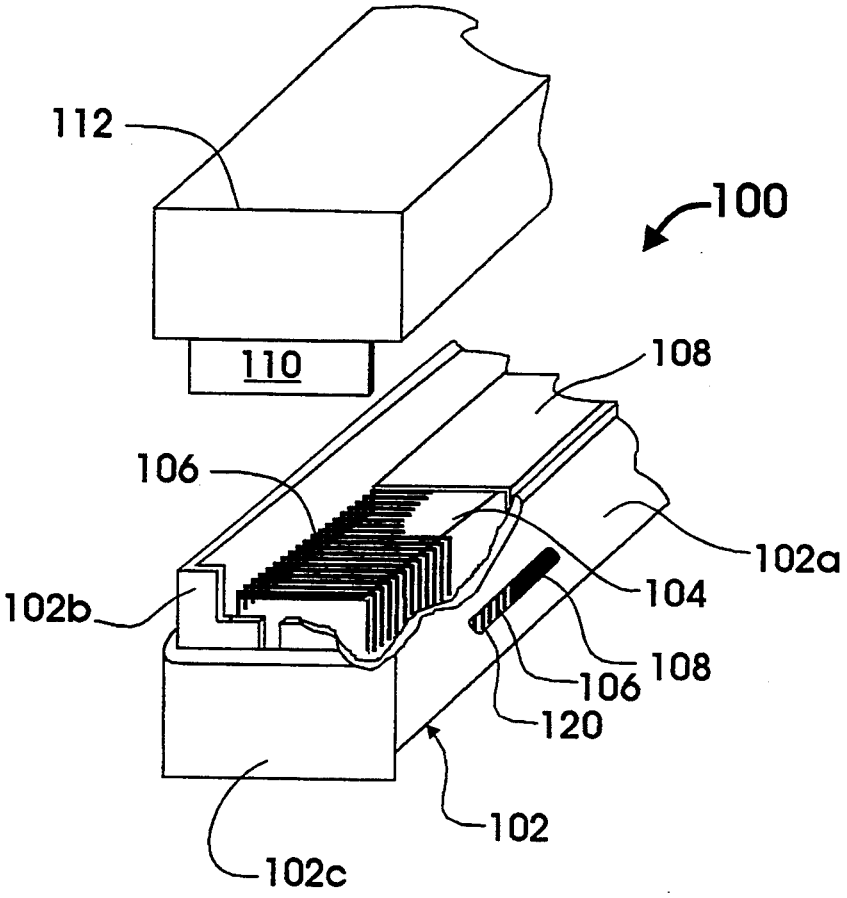
Figure 1 Prior Art
FIG. 1 is a partially-exploded, partially-cutaway, partial view of a paper stapler of the prior art.

FIG. 1 shows a typical paper stapler 100 of the prior art, and has been discussed hereinabove. A salient feature is the view hole 120 which supposedly permits a user to ascertain that the stapler is running out of staples, and needs to be loaded with a fresh supply of staples. As discussed hereinabove, the view hole 120 does not provide the user with a very noticeable cue that the stapler is low on staples.

Figure 2A:
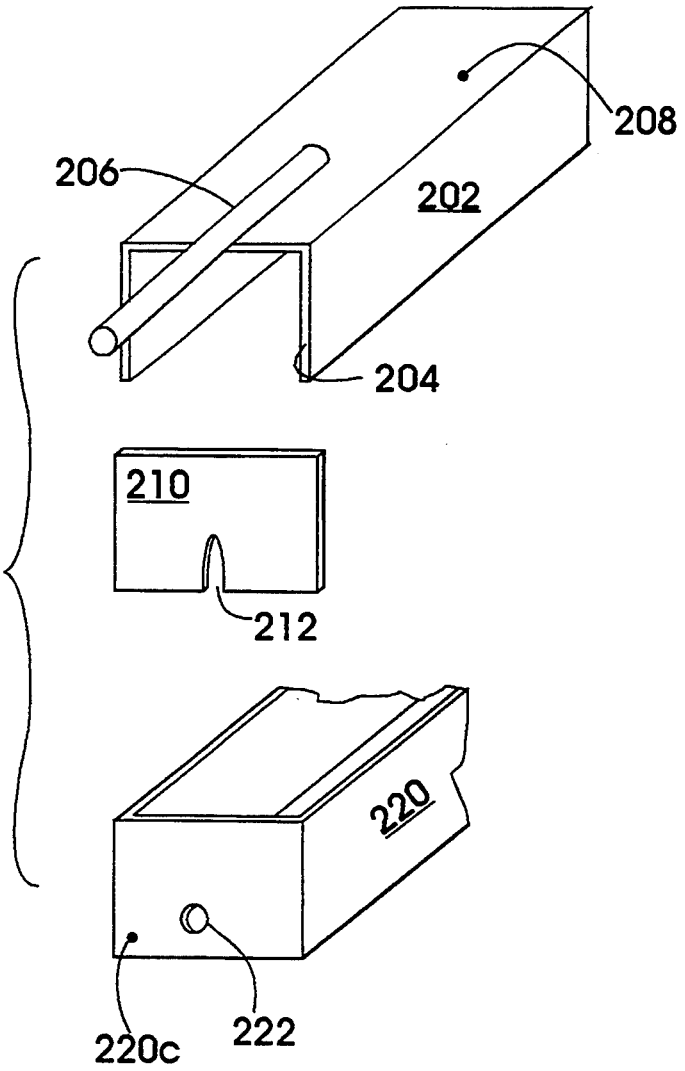
FIG. 2A is a perspective view of elements of one embodiment of the present invention.

FIG. 2a shows an embodiment of the invention. The follower 202 (compare 108, FIG. 1) of a stapler has a front end 204 for advancing staples in a magazine. A pin 206 is disposed in a suitable manner on the top surface 208 of the follower 202. In this exemplary embodiment, the pin 206 is straight, extends longitudinally (along the length of the magazine), and its distal (rear) end is spot welded to the top surface of the follower. Its proximal (front) end extends past the front end of the follower, and above staples (not shown)in front of the follower. Typically, the follower has a thickness that is at least as great as the thickness of staples being advanced by the follower. Hence, the top surface of the follower is slightly higher than the staples being pushed by the follower. Consequently, the pin 206 can be straight, and can lay flat on the top surface of the follower, and will extend over staples being advanced by the follower. The pin 206 is suitably disposed so as to not interfere with a spring (not shown) in the stapler that causes the follower to urge the staples forward in the magazine.

The blade 210 (compare 110) is provided with a notch 212 extending vertically (as viewed) into the blade from its lower edge. As is known, the lower edge of the blade is what pushes the staples out of the ejection slot in the magazine. Such a slot 212 in the bottom edge of the blade will not interfere with, or diminish the efficacy of this important function, primarily because the blade is notched (212) away from the portion of the blade edge that is directly above the "legs" of the staples. The notch (slot) 212 allows the pin to extend past the blade (when there are only a few staples remaining in the magazine), without interfering with the operation of the blade. The notch 212 extends into the blade 210 a depth sufficient to allow the upper housing (108) to compress upon the lower housing (220, described hereinbelow) so that staples may be ejected from the magazine.

The front end 220*c* (compare 102*c*) of the magazine housing 220 (compare 102, the housing 220 is shown somewhat simplified, for illustrative clarity) is provided with a hole 222, at least as large (in diameter) as the diameter of the pin 206, so that the pin 206 can protrude through the hole 222 when the slider (follower) 202 has advanced to a predetermined position related to relatively few staples remaining in the magazine. As the few remaining staples are subsequently ejected by the user, the pin 206 will protrude further through the hole 222 in proportion to the remaining number of staples (the pin will protrude further and further out of the front end of the magazine when there are fewer and fewer remaining staples.

By way of example, the length of the pin (more particularly, how far the proximal end of the pin extends beyond the follower) is established so that it begins to protrude through the hole in the front of the magazine when there are only 10% (e.g., 10) of the magazine's capacity (e.g., 100 staples) of staples remaining in the magazine, and when there are zero staples remaining, the pin protrudes approximately 3/16 inch beyond the front of the lower magazine housing. In other words, the magazine has a capacity to hold a number of staples, and the pin is sized (e.g., length) and disposed (e.g., position on the top of the follower) so as to begin protruding from a corresponding hole in the front end of the magazine when the number of staples remaining in the stapler is approximately 10% of the magazine capacity.

The pin 206, notch 212 and hole 222 are all aligned with one another, in FIG. 2A along the longitudinal centerline of the magazine. It should be understood that these elements could, and may preferably should, be located off center, to one side or the other of the longitudinal centerline, so as to not interfere with other mechanisms (not shown) in the stapler, such as the spring advancing the follower and any elements (e.g., tabs) cooperating with the blade.

Figure 2B:
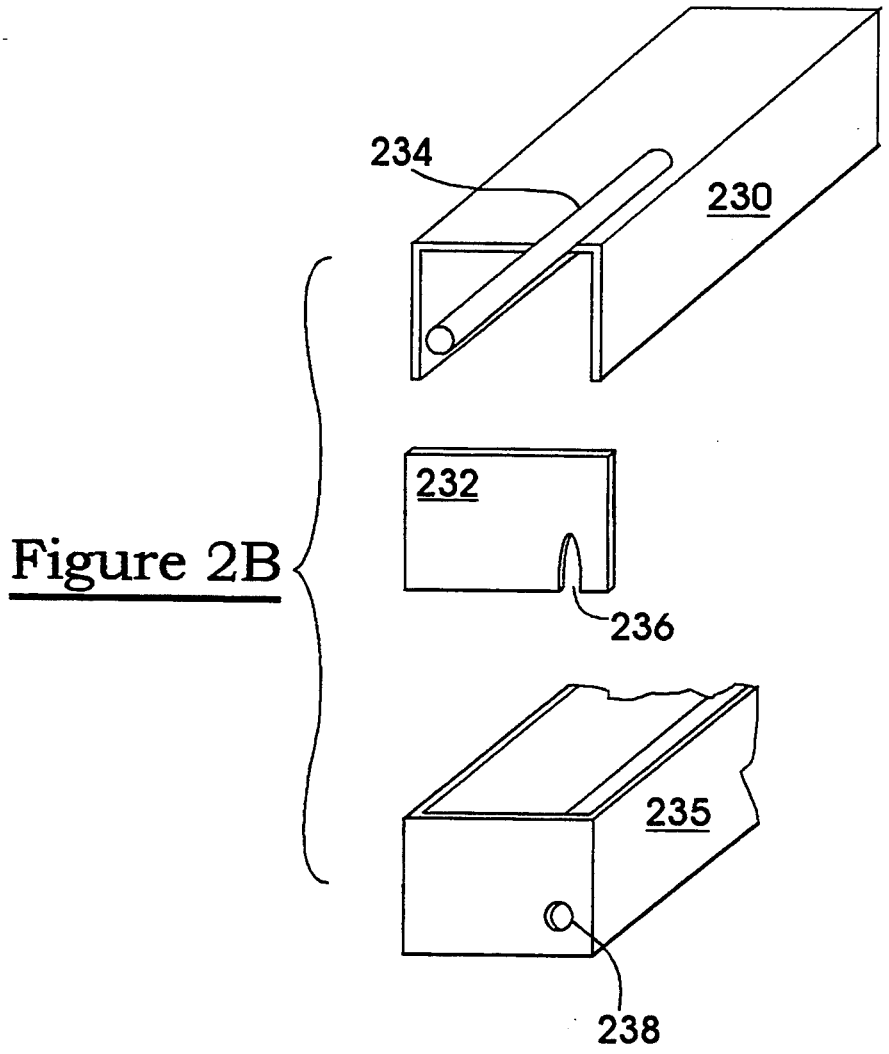
FIG. 2B is a perspective view of modified elements of the one embodiment of the present invention.

FIG. 2B shows an alternate embodiment (modification) of a follower 230 (compare 202), a blade 232 (compare 210) and a magazine 234 (compare 220), wherein the pin 235 (compare 206) is located off-center. As in FIG. 2A, the pin is mounted atop the follower, and it proximal end extends beyond the follower. The proximal end of the pin extends through an off-center notch 236 in the blade, and through an off-center hole 238 in the front of the magazine, and can be distinctively colored to provide a noticeable visual cue to the user that the stapler is low on staples.

Figure 2C:
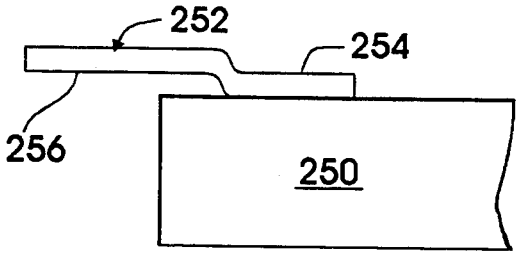
FIG. 2C is a side view of further modified elements of the one embodiment of the present invention.

FIG. 2C shows yet another embodiment (modification) of the follower 250 (compare 202 and 230). In this case, the pin 252 (compare 206 and 234) is not straight. The distal end 254 of the pin 252 is attached to the top surface of the follower. An intermediate portion of the pin is kinked so that the proximal portion 256 of the pin is elevated above the top surface of the follower. The proximal portion 256 of the pin extends longitudinally through a suitable aligned slot (notch) in a blade and through a suitable aligned hole in the front of the magazine. This pin 252 may be disposed on or off center on the follower, and the proximal end may also be distinctively colors (as in FIGS. 2A and 2B).

Figure 3:
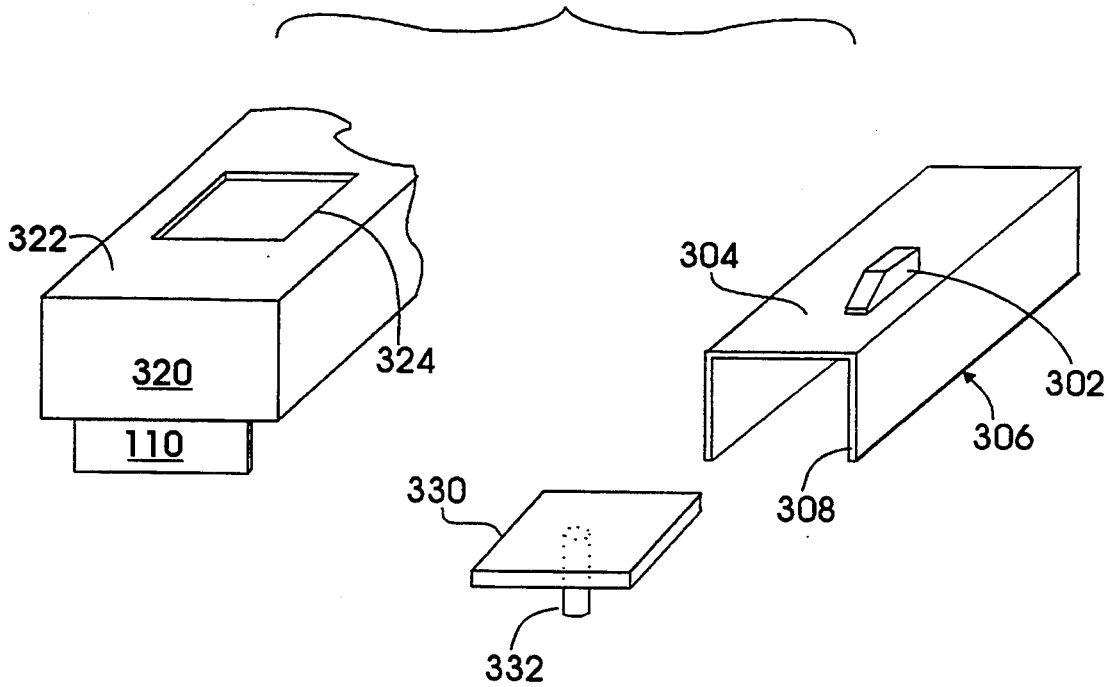
FIG. 3 is an exploded, perspective view of another embodiment of the present invention.

FIG. 3 shows an alternate embodiment of the invention wherein a tactile cue is provided to the user that the stapler is low on staples.

In this embodiment, the a cam element 302 is provided on the top surface 304 of the follower 306 (compare followers 108, 202, 230, 250). Towards the front end 308 of the follower, the cam element is relatively thin, and the cam element increases in thicknesses towards the back of the follower. This forms a type of ramp. The cam element is aligned longitudinally (with respect to the magazine, as were the pins of the FIGS. 2A, 2B and 2C embodiments), and may be disposed on-center (compare the location of the pin 206 in FIG. 2A) or off-center (compare the location of the pin 234 in FIG. 2B) on the top surface of the follower. In this example, the cam element is shown disposed off-center on the top surface of the follower.

The cam element 302 may be a separate component attached in any suitable manner (e.g., by spot welding) to the top surface of the follower, or it can be formed integrally with the follower (as a raised indentation in the top surface of the follower. Generally, in either case, the cam element forms a progressively raised portion of the otherwise (without the cam element) flat top surface of the follower.

The top housing (cap) 320 (compare 108) of the stapler is modified to provide a tactile cue to the user that the stapler is low on staples, in conjunction with the cam element. A portion of the top surface 322 of the top housing is provided with an opening 324. The opening 324 is of any suitable shape or size, and is located near the front end of the top housing 320.

A button-like element 330 is provided, and is of a shape and size corresponding to the shape and size of the opening 324. A cam-follower element 332, such as a pin, extends from the bottom surface of the button-like element 330.

In use, the button-like element 330 is disposed in the hole 324, so that the top surface 322 of the upper housing 320 is relatively smooth (e.g., planar, or slightly curved). The button-like element 330 is only slightly (e.g., 0.010 inches) smaller than the hole 324, so that there is only a small peripheral gap therebetween. When the user pressed down upon the top housing 320, to eject a staple, a relatively smooth surface will be perceived.

When the stapler is low on staples, the follower 306 will have advanced sufficiently that the cam follower 322 comes into contact with the cam element 302. Then, when the user presses down on the top housing, the button-like element 330 will protrude above the top surface of the top housing 320, and the user will perceive a non-smooth, irregular surface. This will provide a tactile cue to the user that the follower has advanced to a certain point, indicative of the stapler being low on staples. As more of the few remaining staples are used, the follower 306 will advance more and more, presenting an ever increasing elevated cam surface (302) to the cam follower 332, and a consequent ever increasing irregularity in the feel of the top surface of the upper housing 320.

In other words, when the follower 306 advances to a predetermined position in the magazine, the button-like element makes the top surface of the top housing of the stapler irregular, thereby providing the user with tactile feedback as to the number of staples remaining in the magazine. As in the embodiments of FIGS. 2A–2C, the position of the cam element 302 can be established so that it begins to raise the button-like element when there are only about 10% of the magazine's capacity of staples remaining. In either embodiment, this threshold can be established to indicate fewer, or more, staples remaining. For example, the tactile and/or visual cues can begin to be noticeable when there are only about 5%, or 0% (completely out of staples), of the magazine's capacity of staples remaining in the stapler.

The button-like element 330 is suitably held in position by gravity, but other means (not shown) for resiliently holding the button-like element down (such as springs, resilient tabs, elastomeric washers, and the like) are within the scope of this invention. Such resilient holding down of the button-like element will be "overridden" by the contact between the cam follower 332 and the cam 302, which will cause the button-like element 330 to elevate above the top surface 322 of the top housing 320 when the stapler is low on staples.

Various modifications and changes to the embodiments described hereinabove are contemplated as being within the scope of the invention. For example, a stapler can be provided with an off-center pin (compare 234) as well as with a cam element (compare 302), and associated elements, for providing multiple indications that the stapler is low on staples.

In any of the embodiments set forth above, the user is alerted to the fact that the stapler is low on staples by virtue of an element (pin or button-like element) protruding from an external surface of the stapler. This is in marked contrast to prior art techniques of providing a view window (120) which provides a barely (at best) discernable cue to the user. Further, the low on staples indicating means of the prior art (e.g., FIG. 1) is a feature of the side of the follower (108). In the present invention, the low on staples indicating means is a feature of the top surface of the follower.

What is claimed is:

1. Paper stapler, comprising:
a magazine having a front end;
a follower in the magazine for urging staples towards the front of the magazine;
a blade for ejecting staples from the front of the magazine;
means, on the follower, for indicating to a user that the stapler is low on staples;
wherein the means for indicating comprises:
a pin disposed on a top surface of the follower;
further comprising:
a notch in the blade aligned with the pin,
wherein:
as the staples are ejected by the blade, a number of staples remaining in the stapler decrements; and
the pin projects through the notch in the blade when the number of staples remaining in the stapler reaches a predetermined number.

2. Paper stapler, according to claim 1, wherein:
the pin is located on-center on the top surface of the follower.

3. Paper stapler, according to claim 1, further comprising:
a hole in the front end of the magazine aligned with the pin.

4. Paper stapler, according to claim 1, wherein:
the pin is straight.

5. Paper stapler, according to claim 1, wherein:
a proximal portion of the pin is distinctively colored.

6. Paper stapler, according to claim 1, wherein:
the magazine has a capacity to hold a number of staples; and
the pin is sized and disposed so as to begin protruding from a corresponding hole in the front end of the magazine when the number of staples remaining in the stapler is approximately 10% of the magazine capacity.

7. Paper stapler, according to claim 1, wherein:
the pin is located off-center on the top surface of the follower.

8. Paper stapler, according to claim 7 wherein:
the notch is located off-center to be aligned with the pin.

9. Paper stapler, according to claim 8, further comprising:
a hole in the front end of the magazine;
wherein:
the hole is located off-center to be aligned with the pin.

10. Paper stapler, according to claim 7, wherein:
the pin is straight.

11. Paper stapler, according to claim 7, wherein:
a proximal portion of the pin is distinctively colored.

12. Paper stapler, according to claim 7, wherein:
the magazine has a capacity to hold a number of staples; and
the pin is sized and disposed so as to begin protruding from a corresponding hole in the front end of the magazine when the number of staples remaining in the stapler is approximately 10% of the magazine capacity.

13. Paper stapler, according to claim 1, wherein:
the pin is kinked, and a portion of the pin extends longitudinally towards the blade at a position elevated above the top surface of the follower.

14. Paper stapler, according to claim 13, wherein:
the pin is located on-center on the top surface of the follower.

15. Paper stapler, according to claim 13, wherein:

the pin is located off-center on the top surface of the follower.

16. Paper stapler, according to claim 15, wherein:

the notch is located off-center to be aligned with the pin.

17. Paper stapler, according to claim 16, further comprising:

a hole in the front end of the magazine;

wherein:

the hole is located off-center to be aligned with the pin.

18. Paper stapler, according to claim 13, wherein:

a proximal portion of the pin is distinctively colored.

19. Paper stapler, according to claim 13, wherein:

the magazine has a capacity to hold a number of staples; and the pin is sized and disposed so as to begin protruding from a corresponding hole in the front end of the magazine when the number of staples remaining in the stapler is approximately 10% of the magazine capacity.

* * * * *